US007441672B2

(12) United States Patent
Cadiente et al.

(10) Patent No.: US 7,441,672 B2
(45) Date of Patent: Oct. 28, 2008

(54) PRODUCE PACKAGING SYSTEM HAVING PRODUCE CONTAINERS WITH ARCHED BOTTOM AND RAISED FEET TO ENABLE UNDER CONTAINER VENTILATION

(75) Inventors: Anthony Cadiente, Salinas, CA (US); Mark Sambrailo, Watsonville, CA (US)

(73) Assignee: Sambrailo Packaging, Inc., Watsonville, CA (US)

( * ) Notice: Subject to any disclaimer, the term of this patent is extended or adjusted under 35 U.S.C. 154(b) by 614 days.

(21) Appl. No.: 11/177,107

(22) Filed: Jul. 7, 2005

(65) Prior Publication Data

US 2005/0242098 A1 Nov. 3, 2005

Related U.S. Application Data

(63) Continuation-in-part of application No. 10/017,893, filed on Dec. 12, 2001, now Pat. No. 7,100,788, which is a continuation-in-part of application No. 09/590,631, filed on Jun. 8, 2000, now abandoned, which is a continuation of application No. 09/060,453, filed on Apr. 14, 1998, now Pat. No. 6,074,676, which is a continuation of application No. 08/591,000, filed on Jan. 24, 1996, now Pat. No. 5,738,890, application No. 11/177,107, which is a continuation-in-part of application No. 10/302,059, filed on Nov. 21, 2002, now Pat. No. 6,962,263.

(51) Int. Cl.

| | |
|---|---|
| ***B65D 6/28*** | (2006.01) |
| ***B65D 8/04*** | (2006.01) |
| ***B65D 8/06*** | (2006.01) |

(52) U.S. Cl. ..... 220/608; 220/366.1; 220/913

(58) Field of Classification Search ..... 220/4.21, 220/4.22, 4.23, 366.1, 608, 676, 913, 636
See application file for complete search history.

(56) References Cited

U.S. PATENT DOCUMENTS 1,800,346 A 4/1931 Slagel (Continued)

FOREIGN PATENT DOCUMENTS

DE 857860 12/1952

(Continued)

OTHER PUBLICATIONS

International Search Report and Written Opinion from Corresponding PCT application No. PCT/US06/26170, Jul. 24, 2007, 6 pages.

(Continued)

*Primary Examiner*—Anthony D Stashick
*Assistant Examiner*—Harry A Grosso
(74) *Attorney, Agent, or Firm*—Beyer Law Group LLP

(57) ABSTRACT

A produce packaging container having an arched bottom surface and raised feet is described herein. The containers each can include upper ventilation slots and lower ventilation channels. The lower ventilation channels are formed by arching the bottoms of the baskets to form cooling flow channels that direct cool air under the bottoms of the containers. Raised supports enable bi-directional cooling airflow to pass underneath the baskets in at least two transverse directions. Bi-directional airflow is also achieved in the upper portion of the baskets through the ventilation slots.

13 Claims, 3 Drawing Sheets

U.S. PATENT DOCUMENTS

| | | | |
|---|---|---|---|
| 1,953,765 | A | 4/1934 | McCluney |
| 2,652,335 | A | 9/1953 | Conti |
| 2,660,529 | A | 11/1953 | Bloom |
| 2,684,907 | A | 7/1954 | Brunsing |
| 2,739,734 | A | 3/1956 | Pugh |
| 2,936,094 | A | 5/1960 | Smith |
| 3,037,658 | A | 6/1962 | Schray et al. |
| 3,042,247 | A | 7/1962 | Bonnet |
| 3,253,762 | A | 5/1966 | Gaunt |
| 3,613,938 | A | 10/1971 | Westcott |
| 3,651,977 | A | 3/1972 | Morgan |
| 3,741,815 | A | 6/1973 | Peterson |
| 3,794,090 | A | 2/1974 | Commisso |
| 3,912,118 | A | 10/1975 | Bird |
| 3,937,389 | A | 2/1976 | Wind |
| 4,206,845 | A | 6/1980 | Christian |
| D256,097 | S | 7/1980 | Amberg |
| 4,390,113 | A | 6/1983 | Bird |
| 4,478,344 | A | 10/1984 | Rehrig |
| D276,216 | S | 11/1984 | Michaud |
| 4,529,088 | A | 7/1985 | Quong |
| 4,570,818 | A | 2/1986 | Borst et al. |
| 4,597,503 | A | 7/1986 | Lates |
| 4,618,069 | A | 10/1986 | Quong |
| 4,664,281 | A | 5/1987 | Falk et al. |
| 4,704,510 | A | 11/1987 | Matsui |
| 4,741,452 | A | 5/1988 | Holzkopf |
| 4,767,008 | A | 8/1988 | Warnecke et al. |
| 4,771,934 | A | 9/1988 | Kalmanides |
| 4,819,822 | A | 4/1989 | Box |
| 4,844,263 | A | 7/1989 | Hadtke |
| 4,859,822 | A | 8/1989 | Ragusa et al. |
| 4,883,195 | A | 11/1989 | Ott et al. |
| 4,974,738 | A | 12/1990 | Kidd et al. |
| D315,100 | S | 3/1991 | Sheehan |
| 5,069,344 | A | 12/1991 | Dehart |
| 5,076,459 | A | 12/1991 | DeHart |
| 5,191,994 | A | 3/1993 | Stauble |
| D339,744 | S | 9/1993 | Seppala |
| 5,265,749 | A | 11/1993 | Zutler |
| D343,576 | S | 1/1994 | Krupa |
| D345,894 | S | 4/1994 | Krupa |
| D348,608 | S | 7/1994 | Wyslotsky |
| 5,339,973 | A | 8/1994 | Edwards et al. |
| D354,436 | S | 1/1995 | Krupa |
| 5,423,453 | A | 6/1995 | Fritz |
| D361,035 | S | 8/1995 | Krupa |
| D361,036 | S | 8/1995 | Krupa |
| D363,022 | S | 10/1995 | Krupa et al. |
| 5,456,379 | A | 10/1995 | Krupa et al. |
| D363,879 | S | 11/1995 | Krupa et al. |
| 5,465,901 | A | 11/1995 | Paine, Jr. |
| 5,515,993 | A | 5/1996 | McManus |
| D376,314 | S | 12/1996 | Krupa |
| D378,192 | S | 2/1997 | Krupa et al. |
| D379,300 | S | 5/1997 | Krupa et al. |
| D380,381 | S | 7/1997 | Krupa et al. |
| D382,795 | S | 8/1997 | Abayhan et al. |
| D385,784 | S | 11/1997 | Krupa et al. |
| 5,686,127 | A | 11/1997 | Stockley, III et al. |
| D393,204 | S | 4/1998 | Goins et al. |
| 5,738,890 | A | 4/1998 | Cadiente et al. |
| 5,803,303 | A | 9/1998 | Timm et al. |
| 5,833,116 | A | 11/1998 | Guillin |
| 5,855,277 | A | 1/1999 | Apps et al. |
| D409,485 | S | 5/1999 | Christy, Jr. |
| 5,947,321 | A | 9/1999 | Vadney |
| 6,007,854 | A | 12/1999 | Cadiente et al. |
| 6,074,676 | A | 6/2000 | Cadiente et al. |
| 6,257,401 | B1 | 7/2001 | Mangla et al. |
| D448,288 | S | 9/2001 | Zettle et al. |
| 6,644,494 | B2 | 11/2003 | Hayes et al. |
| 6,962,263 | B2 | 11/2005 | Cadiente et al. |
| 2003/0198714 | A1 | 10/2003 | Cadiente et al. |

FOREIGN PATENT DOCUMENTS

| | | |
|---|---|---|
| GB | 1074164 | 6/1967 |
| GB | 2160510 A | 12/1985 |
| GB | 2200340 A | 8/1988 |
| WO | WO 00/20286 | 4/2000 |

OTHER PUBLICATIONS

International Search Report, dated Mar. 12, 2003.
International Search Report, dated Apr. 20, 2004.
International Search Report, dated Jun. 23, 2005.
U.S. Appl. No. 11/207,258, filed Aug. 18, 2005.
Chinese Office Action in 02822365.9, mailed Dec. 2, 2005.

PRODUCE PACKAGING SYSTEM HAVING PRODUCE CONTAINERS WITH ARCHED BOTTOM AND RAISED FEET TO ENABLE UNDER CONTAINER VENTILATION

CROSS-REFERENCE TO RELATED PATENT APPLICATIONS

This application is a continuation-in-part of application Ser. No. 10/017,893, filed Dec. 12, 2001 now U.S. Pat. No. 7,100,788 (entitled "Method And Apparatus For Packing And Bi-Directional Cooling Of Produce"), which is a continuation-in-part of application Ser. No. 09/590,631, filed Jun. 8, 2000 now abandoned, which is a continuation of application Ser. No. 09/060,453 filed Apr. 14, 1998 and allowed as U.S. Pat. No. 6,074,676, issued on Jun. 13, 2000, which is a continuation of application Ser. No. 08/591,000, filed Jan. 24, 1996 and issued as U.S. Pat. No. 5,738,890 on Apr. 14, 1998, and claims priority from co-pending application Ser. No. 10/017,893, filed Dec. 12, 2001. Additionally, this application is a continuation-in-part of application Ser. No. 10/302,059, filed Nov. 21, 2002 now U.S. Pat. No. 6,962,263 and entitled "Produce Packaging System Having Produce Containers With Double Arched Bottom Ventilation Channels". This application claims priority to all of the above-referenced applications and patents and also incorporates the above documents by reference.

TECHNICAL FIELD

The present invention relates to apparatus and methods for the improved packing, cooling, storage, and shipping of produce. More particularly, the present invention teaches produce containers with ventilation slots and channels enhanced by the presence of supports that raise the containers enabling the flow of cooling air underneath the produce containers in more than one direction relative to the container.

BACKGROUND

Many produce products are harvested and packed in the field into containers, which are ultimately purchased by the end consumer. Examples of such produce items include, but are not limited to, strawberries, raspberries, other berries, tomatoes, grapes, mushrooms, radishes and broccoli florets. Many of these produce items require substantial post-harvest cooling in order to enable shipping over long distances and to prolong shelf life.

In use, a grower's harvesting crew harvests produce items of the type previously discussed directly from the plant in the field into the container. The containers are then loaded into trays, which contain a specific number of individual containers and the trays, when filled, are loaded onto pallets. After the pallets have been filled and loaded, they are transported to shippers who perform a variety of post-harvest processes to enhance the marketability of the produce itself. For many types of produce, including berries, the packed fruit is then cooled. Commonly berries are cooled by injecting cooling air into one side of a tray and passing the cool air through the individual baskets inside the tray and around the berries stored therein. As the air cools the berries, it picks up heat therefrom which is exhausted from apertures on the opposite side of the tray.

Existing systems are effective at cooling the fruit containers at the outside edges of the trays, but less effective at cooling the fruit in the centers of the trays. This problem is exacerbated when many trays are loaded together on a pallet (and worse still when many pallets are stacked together in a refrigerated transport compartment). The pallet and tray stacking can inhibit the cooling airflow to the extent that the innermost fruit remains relatively warm compared to the cooler outer fruit. This can lead to spoilage in some of the fruit. In order to reduce spoilage, conventional approaches use excessive cooling temperatures to cool the produce. This is relatively effective at cooling the innermost fruit, but is an expensive solution due to higher cooling costs. Additionally, an undesirable consequence of such excess cooling is that the outermost fruit can freeze or nearly freeze resulting in unacceptable product damage. Thus there is a need for a packaging system that can achieve more efficient cooling airflow through the trays and baskets thereby facilitating more even and efficient cooling of produce.

It is noted that some of these cooling problems are addressed by the prior art, notably U.S. Pat. Nos. 5,738,890, 6,074,676, and 6,074,854, held by Sambrailo Packaging. While the inventions taught and claimed in U.S. Pat. Nos. 5,738,890, 6,074,676, and 6,074,854, incorporated herein by reference, provide hitherto unmatched cooling for produce items, improvements can be made.

Among the needed characteristics are reduced cooling times and improved coolant circulation leading to reduced cooling expense for the fruit contained in the baskets. Moreover, it is desirable that improved airflow be supplied through the trays and baskets of the system in order to maximize air transfer rates. Additionally, an enhanced ability to pass cooling flows underneath produce containers in multiple directions is desired. Also, such a system can be configured to integrate with commonly used and preferred shipping formats, for example, in the United States such a system would be compatible with forty by forty eight inch pallets in current use in the grocery industry. Moreover, where different pallet sizes are the standard, for instance in another country, what is further needed is a system which can be scaled to effect the advantages hereof in that pallet system.

SUMMARY OF THE INVENTION

In accordance with the principles of the present invention, produce containers are disclosed.

Embodiments of the invention include a produce container capable of facilitating cooling airflows both underneath and through the container. The containers include a basket body and a lid for covering the basket body. The basket body includes a curved bottom aligned with a pair of basket walls having a curved bottom portion. Another pair of basket walls have a straight bottom. Further, the container includes a plurality of supports on the bottom of the container arranged to lift the basket body such that the flat sides are elevated creating a ventilation gap that passes under the flat sides and under the container to enable a cooling flow to pass under the container in a direction transverse to an air flow through the ventilation channel. Each basket also includes a plurality of ventilation slots and a plurality of ventilation channels that are formed in the basket to facilitate the flow of cooling air through the baskets and underneath the baskets.

These and other aspects of the present invention are described in greater detail in the detailed description of the invention set forth herein below.

BRIEF DESCRIPTION OF THE DRAWINGS

The following detailed description will be more readily understood in conjunction with the accompanying drawings, in which:

FIG. 1(*b*) is a simplified schematic perspective view of the another container embodiment with the lid removed.

FIG. 4(*b*) is a simplified schematic cross-sectional view of the container embodiment shown in FIG. 4(*a*).

It is to be understood that, in the drawings, like reference numerals designate like structural elements. Also, it is understood that the depictions in the Figures are not necessarily to scale.

DETAILED DESCRIPTION OF THE INVENTION

The present invention has been particularly shown and described with respect to certain embodiments and specific features thereof. The embodiments set forth herein below are to be taken as illustrative rather than limiting. It should be readily apparent to those of ordinary skill in the art that various changes and modifications in form and detail may be made without departing from the spirit and scope of the invention.

Implementations of the invention comprise, without limitation, produce containers having an arched ventilation channel that passes under the container in one direction and supports mounted on the container to lift it up forming a ventilation gap enabling another cooling flow to pass under the container in another direction.

Figure 1A:
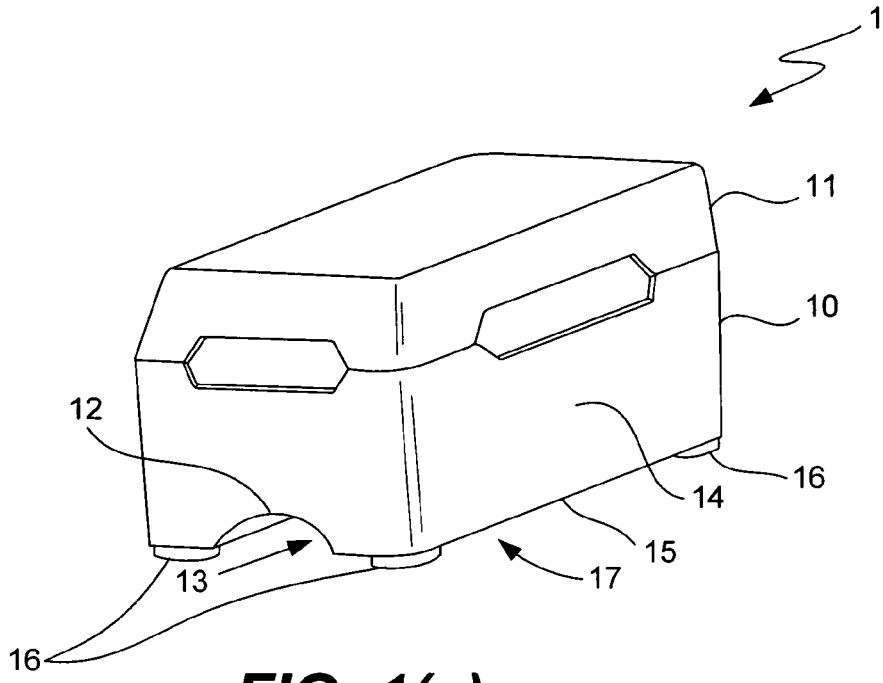
FIG. 1(*a*) is a simplified schematic perspective representation of one closed produce container embodiment according to the principles of the present invention.
Figure 1B:
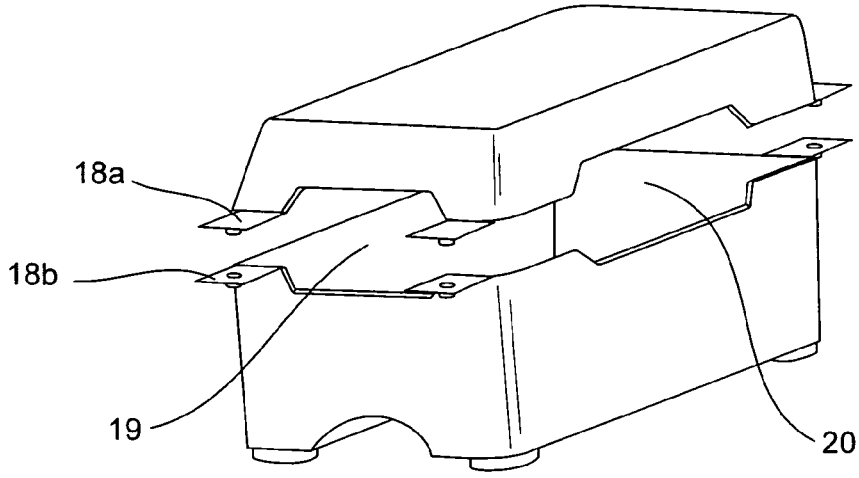

FIG. 1(*a*) depicts a first embodiment of the produce container 1 of the present invention is shown. Produce basket 1 incorporates both a basket body 10 and lid 11. The depicted embodiment is shown as a two piece configuration with the lid secured on the body. It is noted that single piece embodiments also form part of the invention. The basket body 10 further includes a concavity 12 formed in the bottom portion of the basket body 10. This concavity defines a first ventilation channel 13. This concavity 12 is formed by an arched portion of the bottom of the basket body 10. Also, the depicted end walls are curved at the bottom conforming to the arched ventilation channel 13. In the depicted embodiment, the ventilation channel 13 extends longitudinally along the long axis of the basket body 10. Thus, an air flow can be directed down the channel 13 enabling a cooling flow to pass underneath the basket 1 to enhance cooling of produce contained inside. It should be pointed out that although the ventilation channel 13 is oriented so that the airflow passes longwise down the container, other embodiments having transverse channels (e.g., a channel orient to pass airflow along a short axis of the container) are also contemplated by the inventors.

Additionally, the basket body 10 includes walls 14 that are not curved at the bottom. These walls have a straight bottom portion 15 configured to be substantially parallel to a flat surface upon which to container is positioned. On the bottom surface of basket 10 a plurality of supports (or "feet") 16 are located. As depicted here the supports 16 stick out of the bottom and raise the bottom surface of the basket up to form a ventilation gap 17. The ventilation gap 17 enables a portion of a second cooling airflow to pass another cooling airflow underneath the basket 1 to enhance cooling. Thus, two transversely directed airflows can pass underneath the basket 1 to greatly enhance cooling effectiveness.

While this first preferred embodiment is a vacuum formed plastic structure, the principles of the present invention are equally applicable to alternative materials and manufacturing technologies. In the depicted embodiment, the basket is formed of a PET material such as Copolyester 9921, available from Eastman Kodak. Alternative materials include, but are not limited to, various polymeric and monomeric plastics including, but not limited to, styrenes, polyethylenes (including HDPE and LPDE), polyesters, and polyurethanes; metals and foils thereof; paper products including chipboard, pressboard, and flakeboard; wood and combinations of the foregoing. Alternative manufacturing technologies include, but are again not limited to, thermocasting; casting, including die-casting; thermosetting; extrusion; sintering; lamination; the use of built-up structures and other processes well known to those of ordinary skill in the art.

Reference is now made to FIG. 1(*b*) which show a container embodiment having the lid 11 raised off of the basket body 10. The depicted container is similar but not identical to the container 1 of FIG. 1(*a*). In this depicted embodiment the lid 11 can be secured to the basket body 10 using latches 18*a*, 18*b*. The depicted latches comprise button latches (although such latches can also comprise many different latch styles such as are known to those having ordinary skill in the art). While the previously discussed latch configuration has been shown to be particularly effective, the principles of the present invention specifically contemplate alternative latching methodologies. These include, but are specifically not limited to, edge catches, button catches, snaps, hook-and-loop closures, and other closure methodologies well-known to those having ordinary skill in the art. Moreover, the term "latch" as used herein may further comprise alternative lid closure methodologies known to those having ordinary skill in the art including shrink-wrap banding the lid to the body, and the use of elastic bands or adhesive tapes to perform this latching function. The principles of the present invention specifically contemplate alternative latching methodologies. These include, but are specifically not limited to, edge catches, button catches, snaps, hook-and-loop closures, and other closure methodologies well-known to those having ordinary skill in the art. Moreover, the term "latch" as used herein may further comprise alternative lid closure methodologies known to those having ordinary skill in the art.

Additionally, the improved ventilation features 19, 20 of this depicted embodiment are shown. These ventilation features enable cooling air to flow through upper portions of the container 1. Accordingly the ventilation features 19, 20 are located in the upper portion of the container. Various configurations can include the ventilation features 19, 20 located in the lid, the upper portion of the basket body 10, or as shown here, at the interface between lid 11 and body 10. Also, ventilation features can comprise features in other portions of the body. Additionally enhance the cooling effect, some embodiments include more than one ventilation feature (not shown here) one each face of the container.

Figure 2:
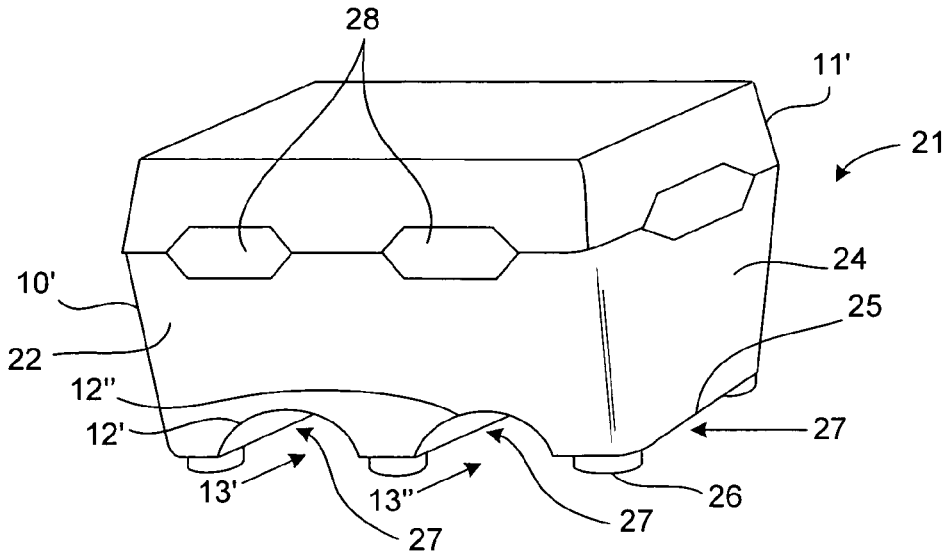
FIG. 2 is a simplified schematic perspective of another container embodiment according to the principles of the present invention.

With reference to FIG. 2 another embodiment is depicted. The produce container 21 of FIG. 2 includes two ventilation channels 13', 13" in the bottom of the basket body 10'. As before, this embodiment incorporates both a basket body 10' and lid 11'. The basket body 10' includes a pair of concavities 12', 12" formed in the bottom portion of the basket body 10'. These concavities are arranged to form a pair of substantially parallel ventilation channels 13', 13". These concavities 12', 12" are formed by a pair of arched portions of the bottom of the basket body 10'. Also, the depicted end walls 22 are curved at the bottom to conform to the arched ventilation channels 13', 13". As explained before the ventilation channels 13', 13" can extend in any direction chosen by the manufacturer. Such dual channel embodiments are particularly suitable for large volume containers (e.g., 2 lbs. containers and such). Airflows can be directed down the channels 13', 13" enabling cooling flows to pass underneath the container to enhance cooling of produce contained inside.

As with the previous embodiments, the basket body 10' includes walls 24 that are not curved at the bottom (i.e., having a straight bottom portion 25) and a bottom having a plurality of supports 26. As described in previous embodiments, the supports 26 stick out of the bottom and raise the bottom surface of the basket up to form a ventilation gap 27. Again the gap 27 enables airflow to pass underneath the basket to enhance cooling. Additionally, it is to be noted that many embodiments can have more than one ventilation slot 28 in a given side of the container 21. Also, as previously described the containers can be formed of many different materials and employ may latch embodiments.

Figure 3:
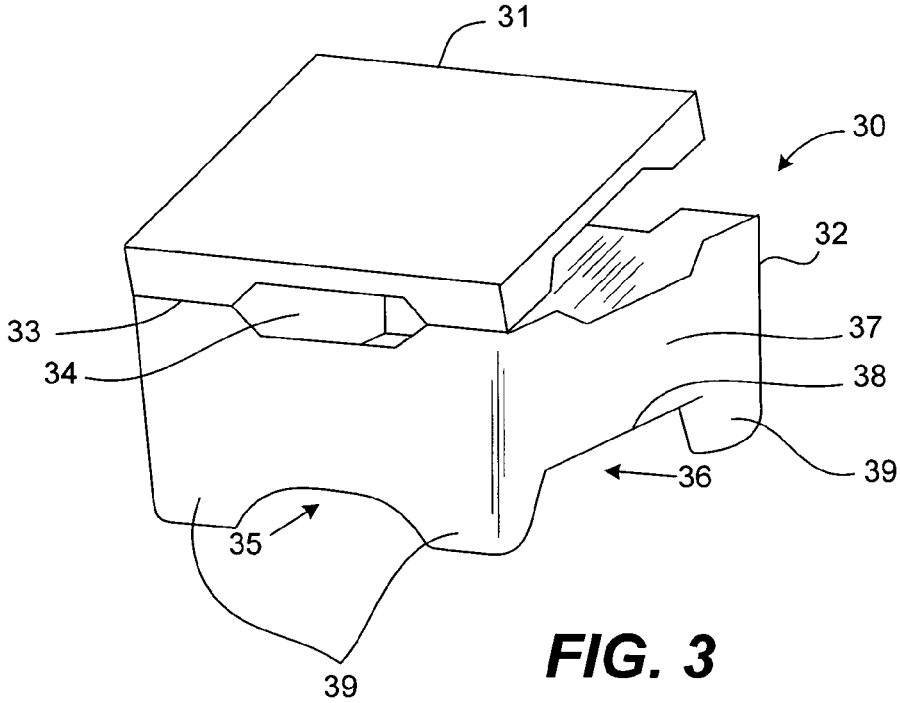
FIG. 3 is a simplified schematic perspective of another container embodiment according to the principles of the present invention.

With reference to FIG. 3, another embodiment of a container 30 is depicted. A hinge 33 is depicted as connecting the lid 31 to the basket body 32. An opening 34 in the hinge defines a ventilation slot when the lid 31 is closed onto the body 32. This ventilation feature along with other vents provides improved cooling. Also, the depicted embodiment includes bottom supports 39 that are smoothly blended into the contour of the bottom of the container 30. Thus, a ventilation channel 35 is defined as extending from one wall to an opposite wall defined by a curved bottom surface of the container. Also, the supports 39 lift the container 30 to define a ventilation gap 36 under the container. As before, the two opposing walls 37 have a flat bottom edge 38 that is lifted up by the supports 39 to define the gap 36.

Figure 4A:
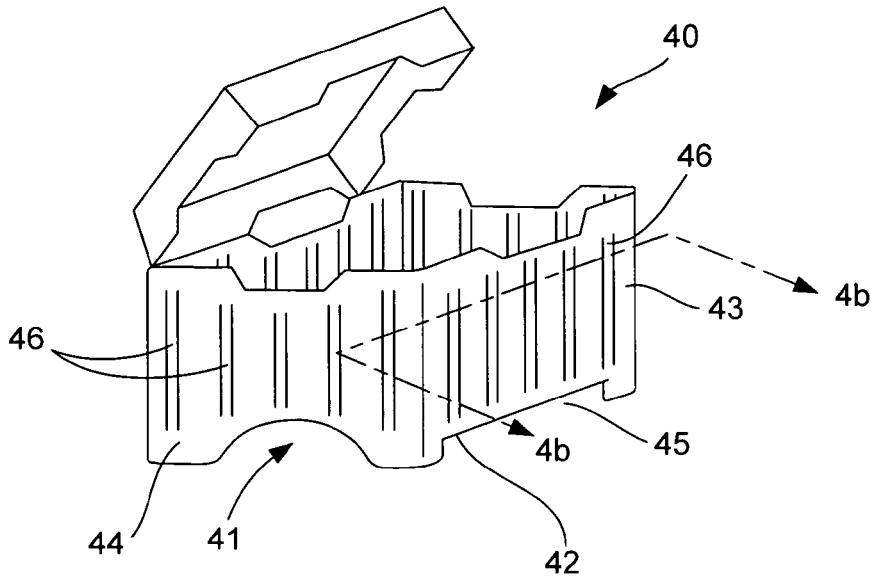
FIG. 4(*a*) is a simplified schematic perspective view of a container embodiment having one type of structural reinforcement features formed thereon in accordance with the principles of the present invention.
Figure 4B:
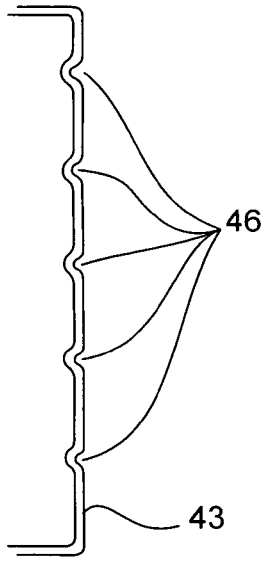

FIGS. 4(*a*) & 4(*b*) depicts another embodiment of a container 40 constructed in accordance with the principles of the invention. Also depicted is a cross-section line 4*b*—4*b* which depicts a portion of a basket wall of the container (described in greater detail with respect to FIG. 4(*b*)) to highlight structural reinforcement features. The curved bottom defining ventilation channel 41 is also depicted, as is the flat bottoms 42 of the side walls 43 that are elevated by the supports 44 to form the ventilation gap 45. In the depicted embodiment, the side walls 43 include a series of structural reinforcing features 46 configured to stiffen of otherwise strengthen the container.

FIG. 4(*b*) is a cross-section view of the basket body. The depicted side wall 43 is shown with a set of reinforcing ribs 46 that can be used to increase the strength of the container. Here the features 46 are shown as a series of long deformations or grooves that extend down the sidewalls 43. Such features can be located on some, all, or none of the walls, and also the lid. Additionally, a vast array of shapes and sizes can be employed as reinforcement structures. Additionally, the inventors point out that for many applications substantially smooth walls (especially the inner container walls) can be advantageously employed in accordance with the principles of the invention. The many figures of the drawings include many depictions of such smooth wall implementations.

While the preceding discussion regarding a first preferred embodiment has centered on a one piece basket incorporating the basket body and lid joined by a hinge, it will be immediately apparent to those of ordinary skill in the art that the principles of the present invention may with equal facility be embodied in a two piece implementation utilizing a separate body and lid. This embodiment is specifically contemplated by the teachings of the present invention.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. In particular, the use of alternative basket forming technologies, tray forming technologies, basket and tray materials and specifications, basket shapes and sizes to conform to differing produce requirements, and vent configurations are all contemplated by the principles of the present invention.

We claim:

1. A produce container comprising:

a basket body with a bottom portion having a base and wherein the basket body comprises a pair of sidewalls and a pair of endwalls such that the base, sidewalls, and endwalls are integrally connected;

a lid for covering the basket body;

a plurality of ventilation slots formed in the container to facilitate a flow of cooling air through the container when the lid is closed;

a bottom portion of the pair of endwalls have a substantially straight contour;

a first ventilation channel is formed in the bottom portion of the basket body by forming a curved bottom portion and curved bottom portions of the sidewalls that together define an arched ventilation channel that passes under the container to facilitate a flow of cooling air underneath the container along the length of the channel in a first direction; and a plurality of supports formed at the bottom portion of the basket body to elevate the container above a resting surface forming a space thereunder to facilitate flow of cooling air underneath the container in a second direction such that the flow in the first direction and the flow in the second direction are transversely oriented with respect to each other.

2. The produce container of claim 1 further including a second ventilation channel arranged substantially parallel to the first ventilation channel.

3. The produce container of claim 1 wherein the plurality of supports are smoothly blended into the contour of the bottom portion of the basket body.

4. The produce container of claim 1 wherein the basket body has substantially smooth inner surfaces.

5. The produce container of claim 1 wherein the basket body has structural reinforcement features.

6. The produce container of claim 1 wherein the lid is attached to the basket body with a hinge.

7. The produce container of claim 6 wherein at least one of the plurality of ventilation slots is formed in the lid enabling a cooling flow to pass through said ventilation slot when the container is closed.

8. The produce container of claim 1 wherein the lid is secured to the basket body using a latch.

9. The produce container of claim 8 wherein the latch comprises a means for securing the lid to the basket.

10. The produce container of claim 1 wherein the plurality of ventilation slots include:

a first set of ventilation slots formed in an upper portion of said basket to enable a cooling flow to pass through the basket in a first direction; and a second set of ventilation slots formed in an upper portion of said basket, said second ventilation slots being disposed to enable the cooling flow to pass through the basket in a second direction that is transverse to the first direction.

11. The produce container of claim 1 wherein the plurality of ventilation slots include a first set of ventilation slots and a set of second ventilation slots wherein the first set of ventilation slots is substantially perpendicular to the second set of ventilation slots.

12. The container of claim 10 wherein the first set of ventilation slots is formed between the lid and the basket body.

13. The container of claim 10 wherein the second set of ventilation slots is formed between the lid and the basket body.

* * * * *